US011910919B2

(12) United States Patent
Chesbrough

(10) Patent No.: US 11,910,919 B2
(45) Date of Patent: Feb. 27, 2024

(54) CLOSET ORGANIZER

(71) Applicant: Richard Merrell Chesbrough, San Diego, CA (US)

(72) Inventor: Richard Merrell Chesbrough, San Diego, CA (US)

( * ) Notice: Subject to any disclaimer, the term of this patent is extended or adjusted under 35 U.S.C. 154(b) by 135 days.

(21) Appl. No.: 17/511,912

(22) Filed: Oct. 27, 2021

(65) Prior Publication Data

US 2022/0279924 A1 Sep. 8, 2022

Related U.S. Application Data

(60) Provisional application No. 63/207,442, filed on Mar. 2, 2021.

(51) Int. Cl.

| | |
|---|---|
| ***A47B 61/00*** | (2006.01) |
| ***A47G 25/14*** | (2006.01) |
| *A47G 25/06* | (2006.01) |

(52) U.S. Cl.

CPC ..... *A47B 61/003* (2013.01); *A47G 25/1471* (2013.01); *A47G 25/0692* (2013.01); *A47G 25/145* (2013.01)

(58) Field of Classification Search

CPC ..... A47B 61/003; A47G 25/0692; A47G 25/1471; A47G 25/06; A47G 25/145; A47G 25/743; A47G 25/746; A47G 25/1442; A47G 25/26; A47F 5/005

See application file for complete search history.

(56) References Cited

U.S. PATENT DOCUMENTS 2,868,389 A * 1/1959 Friend ..... A47G 25/1471 211/123
2,895,618 A * 7/1959 Nathan ..... A47G 25/0692 211/123
3,481,483 A * 12/1969 Hill ..... B60R 7/10 224/927
3,991,884 A * 11/1976 DeMaagd ..... A47F 3/08 211/1.51
D247,085 S * 1/1978 Stoddard ..... D6/328

(Continued)

FOREIGN PATENT DOCUMENTS

DE 3333295 A1 4/1985

OTHER PUBLICATIONS https://www.amazon.com/esowemsn-silicone-clothes-windproof-antioff/dp/b07y891kpq/ref=sr_1_9?dchild=1&keywords=hanger+spacers&qid=1626371322&sr=8-9.

https://www.amazon.comxangar-clothes-hanger-spacersorganizer/dp/b01b1g6va4/ref=sr_1_8?dchild=1&keywords=hanger+spacers&qid=1626371322&sr=8-8.

*Primary Examiner* — Devin K Barnett

(74) *Attorney, Agent, or Firm* — Jacob M. Ward; Ward Law Office LLC

(57) ABSTRACT

A closet organizer can be configured to cooperate with a closet rod and to support a hanger hook. The closet organizer can have a main body with a longitudinal axis. The main body can include a plurality of ridges, a plurality of grooves, and a slit. Each of the ridges can be radially disposed on the main body relative to the longitudinal axis. Each of the ridges can include a first sloped side and a second sloped side. Each of the grooves can be disposed between the first sloped side of one ridge and the second sloped side of another ridge. Each of the grooves can be configured to receive the hanger hook. The slit can be formed along the main body on the longitudinal axis. The slit can be configured to receive the closet rod, thereby allowing the main body to be disposed about the closet rod.

8 Claims, 7 Drawing Sheets

(56) References Cited

U.S. PATENT DOCUMENTS 4,361,241 A * 11/1982 Stoddard ..... A47F 7/163 D6/681.3
4,415,093 A * 11/1983 Livingston ..... A47G 25/1471 211/113
4,548,328 A * 10/1985 Brauning ..... A47F 7/24 211/205
4,577,766 A * 3/1986 Miller ..... A47G 25/0692 211/113
4,723,665 A 2/1988 Benedict et al.
4,760,929 A * 8/1988 Fedorchak ..... A47F 7/24 211/105.1
4,863,081 A * 9/1989 Gabbert ..... B60R 7/10 224/927
4,971,210 A * 11/1990 Blumenkranz .... A47G 25/0692 211/105.1
5,018,694 A * 5/1991 Olson ..... A47G 25/1471 248/340
5,582,306 A 12/1996 Balter et al.
D438,450 S * 3/2001 Jones ..... D8/376
6,488,159 B2 * 12/2002 Shuen ..... A47G 25/0692 211/105.3
6,568,545 B2 * 5/2003 Feder ..... A47F 7/24 211/124
7,296,697 B2 11/2007 Costa et al.
7,886,918 B1 2/2011 Sauer et al.
7,900,783 B2 3/2011 Fernandez et al.
8,033,405 B2 10/2011 Wang
8,374,926 B2 2/2013 Solomon
8,577,759 B2 11/2013 Solomon
8,579,127 B2 11/2013 Dyck
8,646,624 B2 2/2014 Fernandez et al.
9,115,504 B2 8/2015 Wallance
9,259,082 B2 2/2016 Barre et al.
D758,092 S 6/2016 Cohen
9,402,494 B1 * 8/2016 O'Brien ..... A47F 7/19
9,782,030 B1 * 10/2017 Bell ..... A47G 25/1471
10,299,615 B1 * 5/2019 Donegan ..... A47G 25/1471
10,628,666 B2 4/2020 Sareen et al.
10,640,904 B2 5/2020 Underly et al.
10,702,216 B2 7/2020 Sareen et al.
11,072,292 B1 * 7/2021 Martin, IV ..... B60R 7/10
D973,373 S * 12/2022 Saunders ..... D8/380
2005/0023229 A1 2/2005 Ashley et al.
2006/0278594 A1 * 12/2006 Macon ..... A47B 61/003 211/123
2007/0080120 A1 4/2007 Greiner
2011/0042335 A1 2/2011 McNicholas
2016/0160515 A1 6/2016 Wallance
2019/0191910 A1 * 6/2019 Davis ..... A47B 61/003
2021/0030182 A1 * 2/2021 Donegan ..... A47G 25/0692
2022/0279924 A1 * 9/2022 Chesbrough ..... A47B 61/003

* cited by examiner

CLOSET ORGANIZER

CROSS-REFERENCE TO RELATED APPLICATIONS

This application claims the benefit of U.S. Provisional Application Ser. No. 63/207,442 filed on Mar. 2, 2021. The entire disclosure of the above application is incorporated herein by reference.

FIELD

The present disclosure relates to organization and, more particularly, to a closet organizer.

INTRODUCTION

This section provides background information related to the present disclosure which is not necessarily prior art.

Traditionally coats, shirts, dresses, and other types of garments have been stored on hangers in closets. Each hanger is hung by placing a hanger hook of the hanger over a closet rod disposed within the closet. The closet rod can allow each hanger to slide along the closet rod, which can occur accidently when hangers are removed and/or new hangers are hung on the closet rod. Undesirably, hangers being unevenly spaced on the closet rod can cause several issues. For example, this can hinder a user from being able to see individual garments when the garments are bunched in close proximity to each other. In addition, delicate garments can be damaged by being pressed against other garments. Also, when hangers are unevenly spaced, the closet can appear not aesthetically pleasing and messy to the user. Further, lengths of closet rods can fluctuate according to a size of the closet. Undesirably, this can result in a traditional closet organizer not fitting the length of a given closet rod.

There is a continuing need for a closet organizer and method for evenly spacing hanger hooks apart along a closet rod. Desirably, the closet organizer can accommodate closet rods of varying lengths.

SUMMARY

In concordance with the instant disclosure, a closet organizer and method for evenly spacing hangers along a closet rod, and which can accommodate closet rods of varying lengths, has been surprisingly discovered.

In certain embodiments, closet organizers can be configured to cooperate with a closet rod and to support a hanger hook. The closet organizer can have a main body with a longitudinal axis. The main body can include a plurality of ridges, a plurality of grooves, and a slit. Each of the ridges can be radially disposed on the main body relative to the longitudinal axis. Each of the ridges can include a first sloped side and a second sloped side. Each of the grooves can be disposed between the first sloped side of one ridge and the second sloped side of another ridge. Each of the grooves can be configured to receive the hanger hook. The slit can be formed along the main body on the longitudinal axis. The slit can be configured to receive the closet rod, thereby allowing the main body to be disposed about the closet rod.

In certain embodiments, closet organizers can be configured to cooperate with a closet rod and to support a hanger hook. The closet organizer can have a main body with a longitudinal axis. The main body can include a plurality of ridges and a plurality of grooves. Each of the ridges can be radially disposed on the main body relative to the longitudinal axis. Each of the grooves can be disposed between two of the ridges. Each of the grooves can be configured to support the hanger hook. At least one of the ridges can be configured to move between a compressed state and an expanded state.

In certain embodiments, methods for using a closet organizer can include providing the closet organizer. The closet organizer can be configured to cooperate with a closet rod and to support a hanger hook. The closet organizer can have a main body with a longitudinal axis. The main body can include a plurality of ridges and a plurality of grooves. Each of the ridges can be radially disposed on the main body relative to the longitudinal axis. Each of the grooves can be disposed between two of the ridges. At least one of the ridges can be configured to move between a compressed state and an expanded state. The closet organizer can be engaged with the closet rod. At least one of the ridges can be selectively positioned in the compressed state. At least one of the ridges can be selectively positioned in the expanded state. The hanger hook can be selectively disposed on one of the grooves.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

Figure 4:
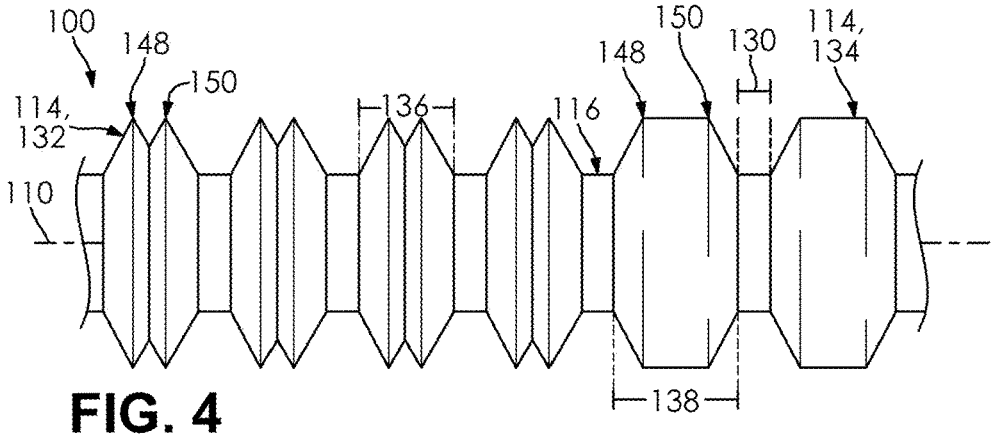
FIG. 4 is a front elevational view of the closet organizer, according to certain embodiments, wherein each of the ridges has a first ridge peak and a second ridge peak.
Figure 5:
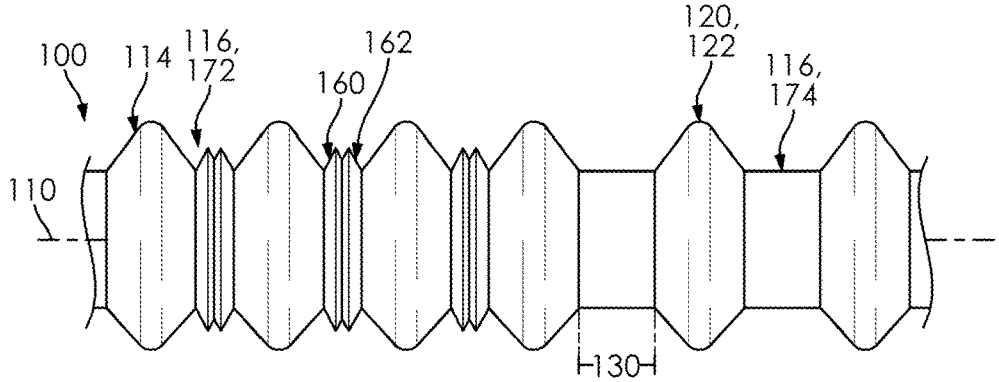
FIG. 5 is another front elevational view of the closet organizer, according to certain embodiments, wherein each of the grooves has first groove peak and a second groove peak.
Figure 6A:
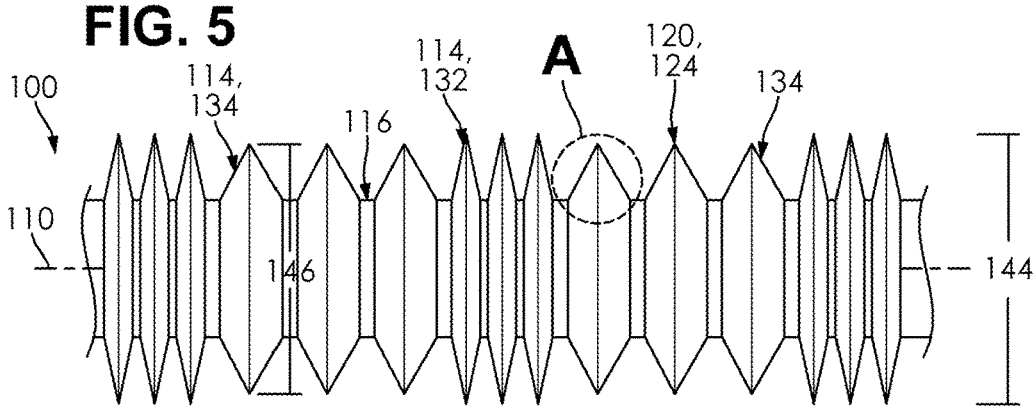
Figure 6B:
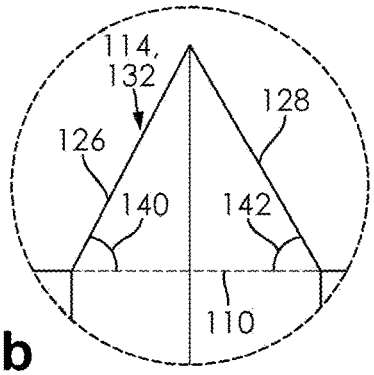
Figure 7:
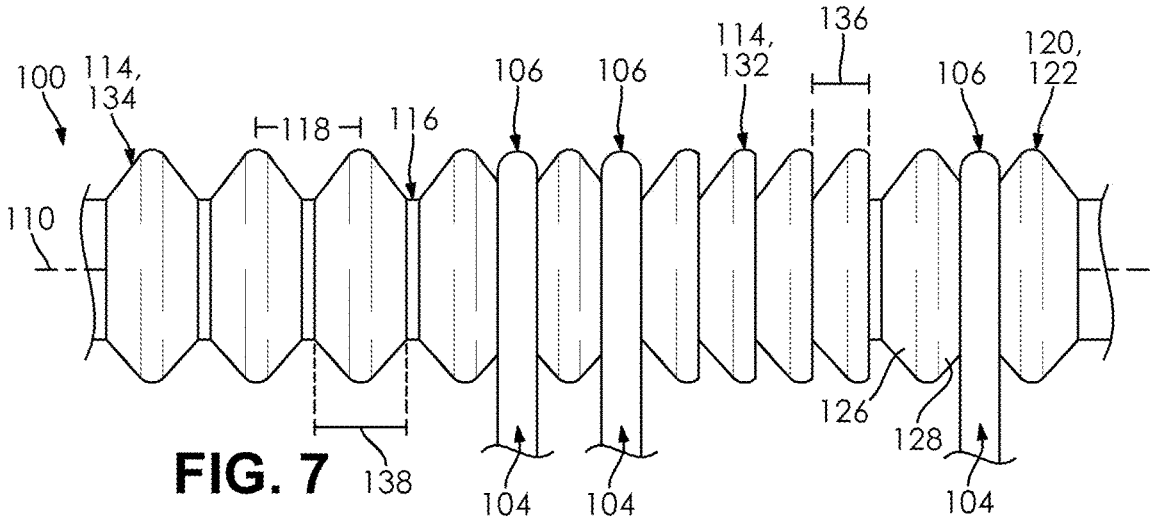
Figure 8:
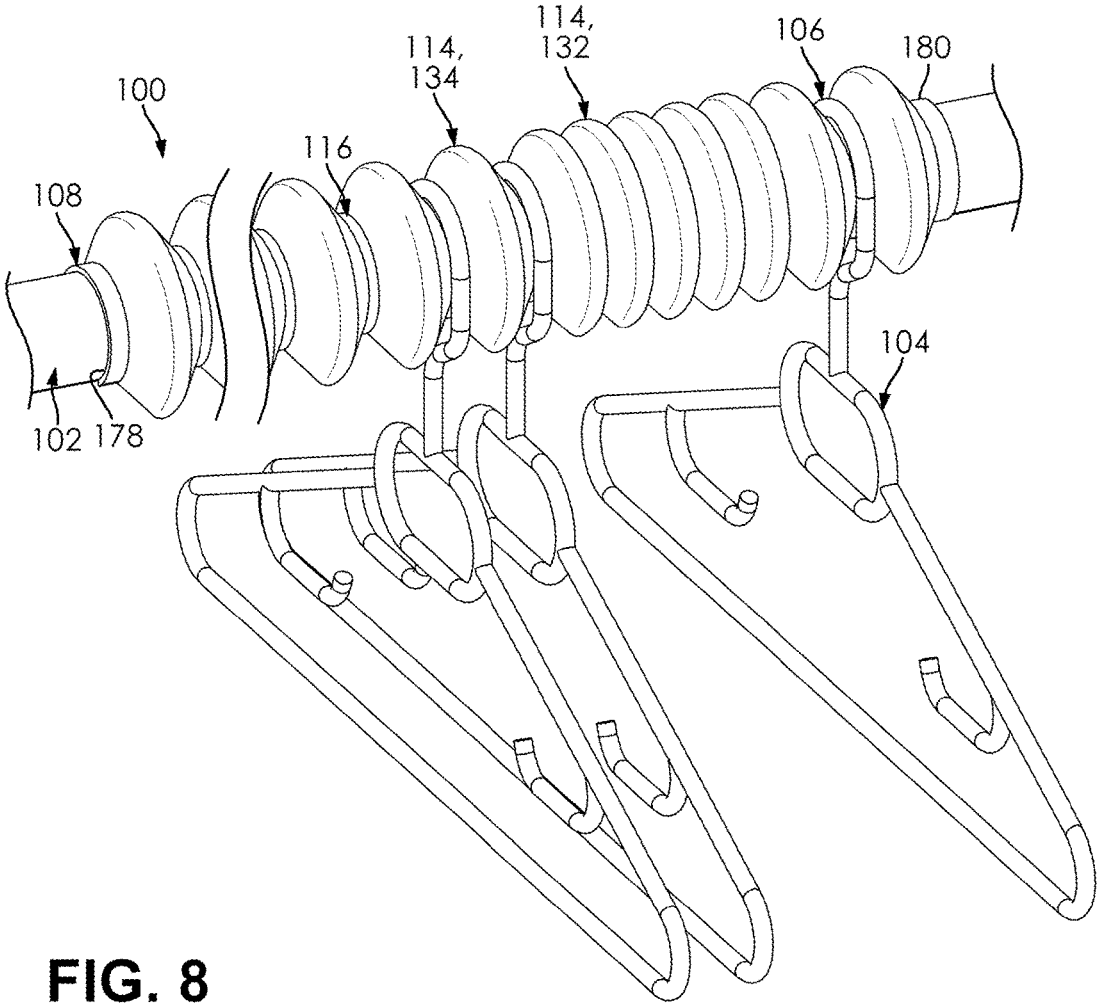
Figure 9:
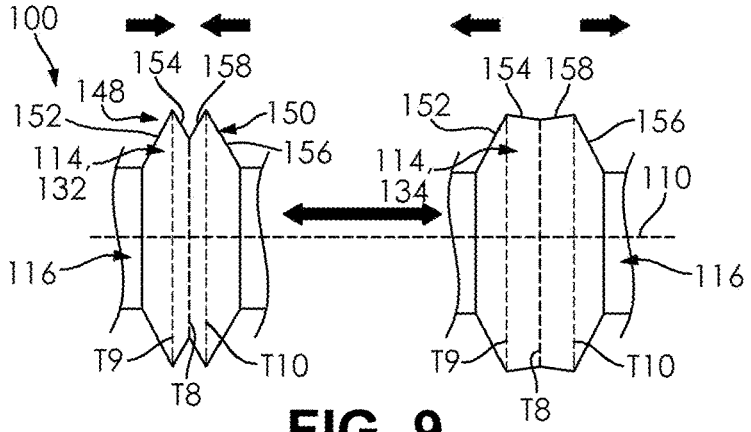
Figure 10:
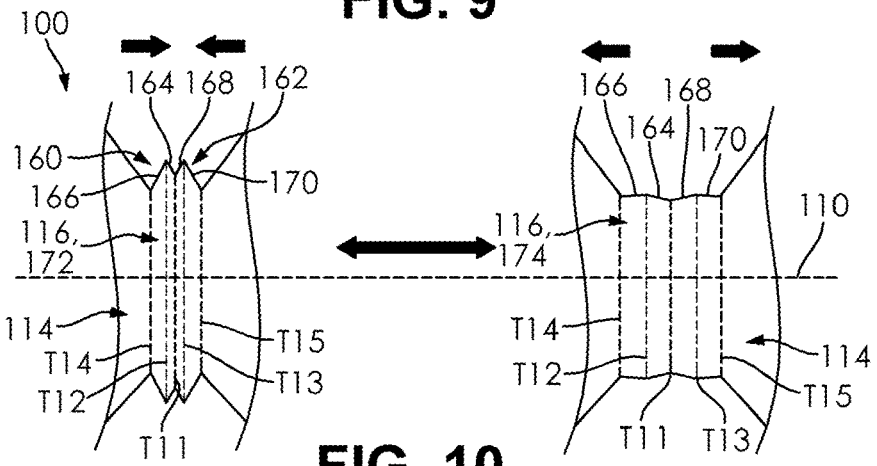
Figure 11:
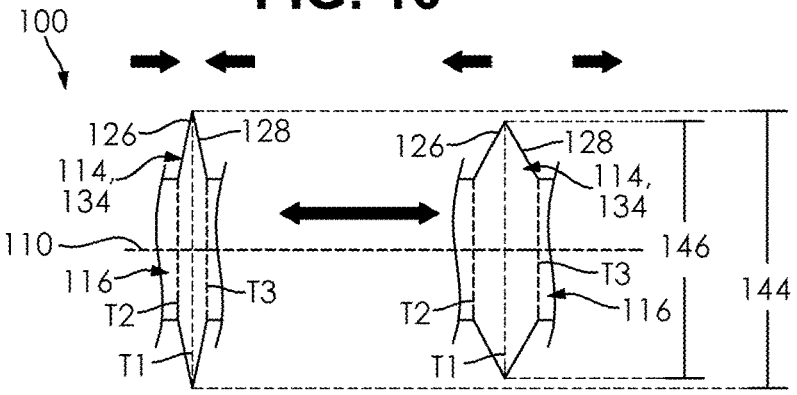
Figure 12:
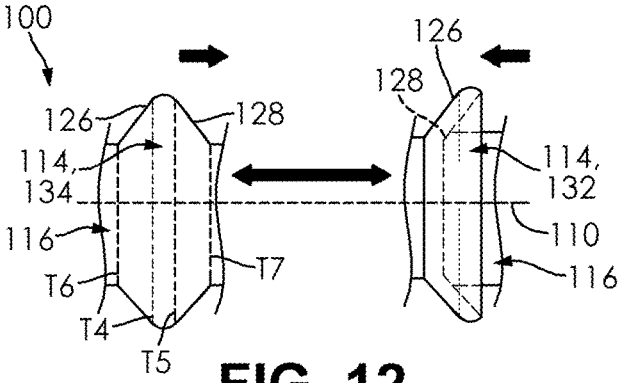
Figure 13:
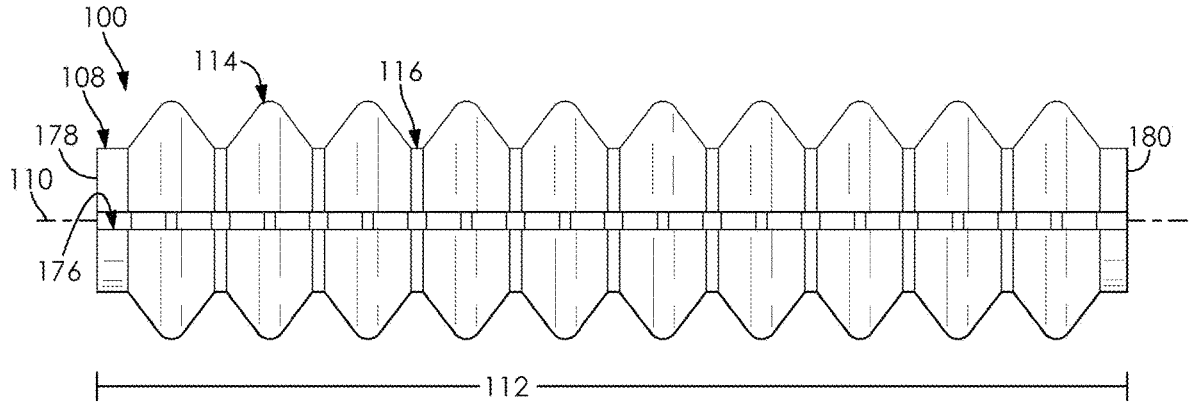
Figure 14:
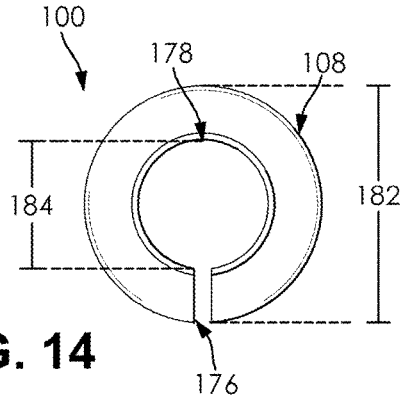
Figure 15:
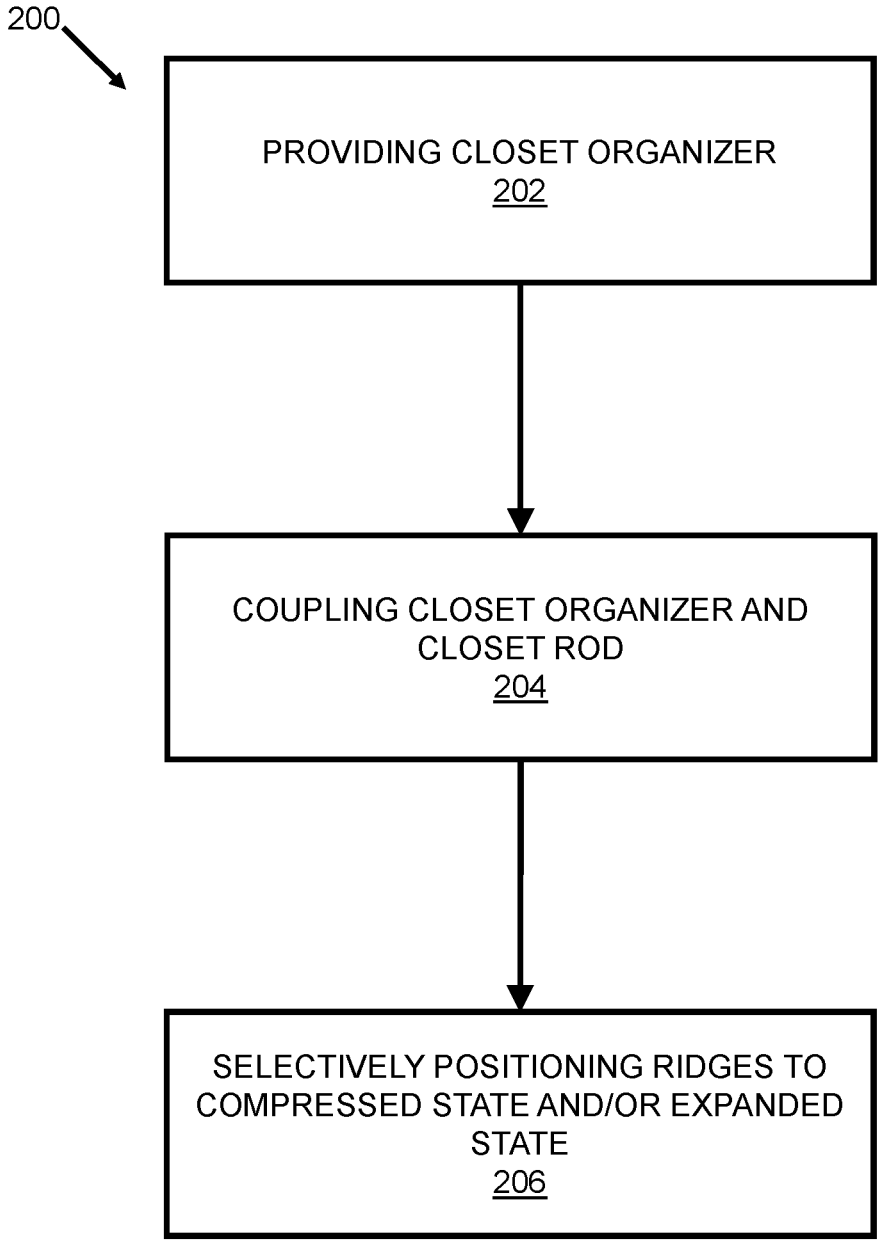
Figure 16:
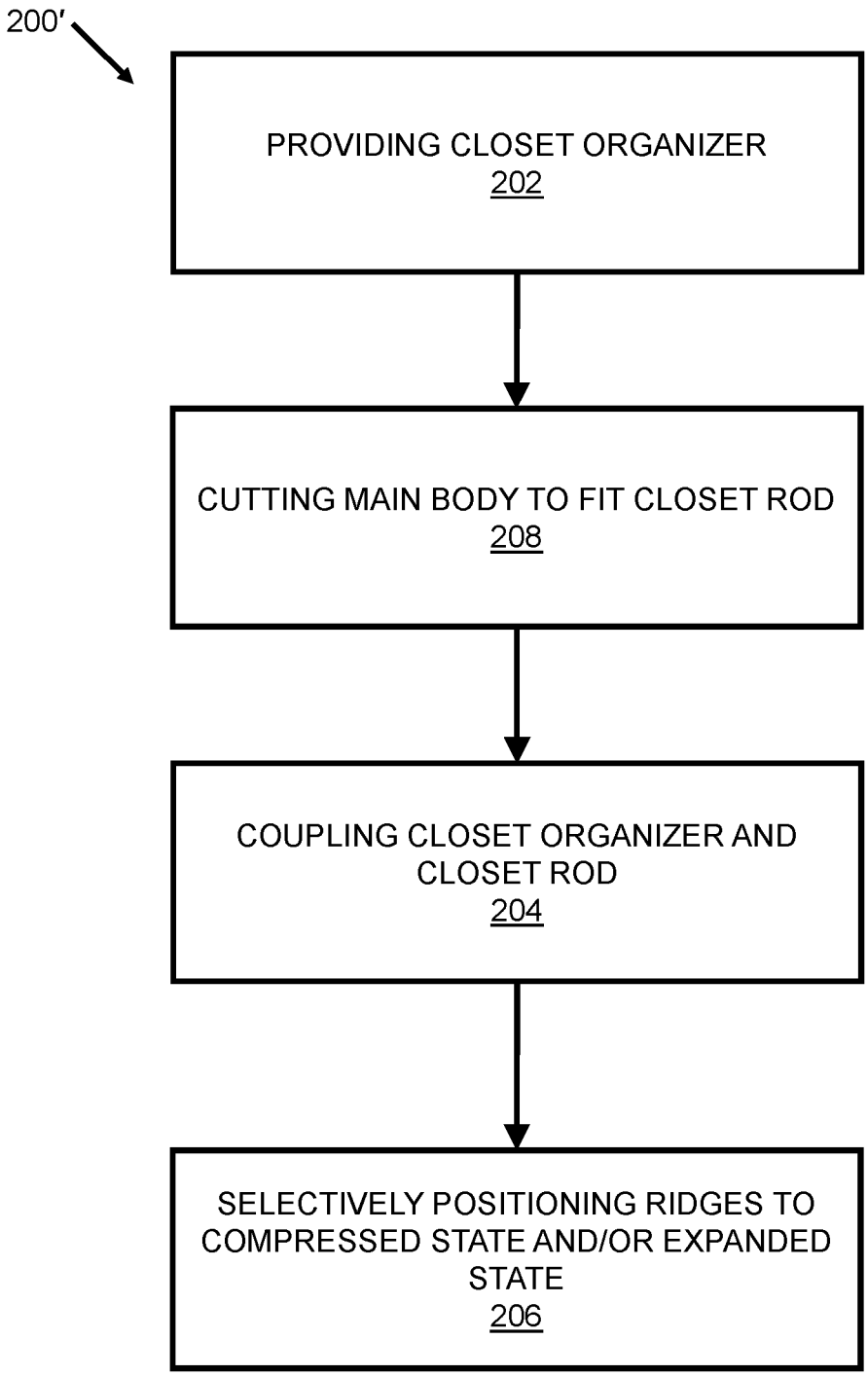

FIG. 6*a* is a further front elevational view of the closet organizer, according to certain embodiments, wherein each of the ridges has a pointed top;

FIG. 6*b* is an enlarged elevational view of the closet organizer in FIG. 6*a* taken at call-out A, including a first sloped side, a second sloped side, a first angle, and a second angle;

FIG. 7 is a yet further elevational view of the closet organizer, according to certain embodiments, including hanger hooks disposed on one of the grooves;

FIG. 8 is a top perspective view of the closet organizer disposed on the closet rod, according to certain embodiments, including hangers disposed in grooves of the closet organizer;

FIG. 9 is a front elevational view of a segment of the closet organizer shown in FIG. 4, showing one of the ridges moving between a compressed state and an expanded state, and further showing movement arrows that show the direction of force required to move between the compressed state and the expanded state;

FIG. 10 is a front elevational view of a segment of the closet organizer shown in FIG. 5, showing one of the grooves moving between a groove compressed state and a groove expanded state, and further showing movement arrows that show the direction of force required to move between the groove compressed state and the groove expanded state;

FIG. 11 is a front elevational view of a segment of the closet organizer shown in FIG. 6*a*, showing one of the ridges moving between the compressed state and the expanded state, and further showing movement arrows that show the direction of force required to move between the compressed state and the expanded state;

FIG. 12 is a front elevational view of a segment of the closet organizer shown in FIG. 7, showing one of the ridges moving between the compressed state and the expanded state, and further showing movement arrows that show the direction of force required to move between the compressed state and the expanded state;

FIG. 13 is a bottom plan view of the closet organizer, according to certain embodiments, including a slit formed on a main body of the closet organizer, and the slit shown closed prior to the placement of the closet organizer over a closet rod;

FIG. 14 is a left side elevational view of the closet organizer shown in FIG. 13, including a first end aperture;

FIG. 15 is a flowchart showing a method for using a closet organizer, according to certain embodiments; and FIG. 16 a flowchart showing another method for using a closet organizer, according to certain embodiments.

DETAILED DESCRIPTION

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9,1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

As used herein, the term "transition line" can include a folding line, a crease, a hinge, a region of thinner material, and/or a region of thicker material to facilitate certain adjacent structures to move, bend, stretch, and/or fold along the transition line. With reference to FIGS. 1-12, a closet organizer 100 is shown. The closet organizer 100 can be configured to cooperate with a closet rod 102 and to support one or more hangers 104 each having a hanger hook 106, as shown in FIGS. 7-8. As will be discussed in further detail, the closet organizer 100 can facilitate greater organization for garments to allow for better visualization and display of garments for easier selection, to allow for optimizing space on the closet rod 102, and to allow for aesthetically pleasing customization of closet space.

Now referencing FIGS. 1 and 4-7, the closet organizer 100 can have a main body 108 with a longitudinal axis 110. The longitudinal axis 110 can be parallel with the closet rod 102. The main body 108 can have a max length 112, as shown in FIG. 2. The max length 112 can be around a rod length of the closet rod 102. In some instances, the max length 112 can be greater than the rod length of the closet rod 102. Desirably, this can permit the main body 108 to have extra length, which can be cut by a user to reduce the max length 112 to match the length of the closet rod 102. In certain examples, the max length 112 can be about 48 inches. It should be appreciated that a skilled artisan can select different dimensions for the max length 112, as desired.

The main body 108 can be manufactured from a variety of different materials. In certain examples, the main body 108 can be manufactured from a flexible material. Advantageously, and as will be discussed in more detail below, this can allow the main body 108 to be expanded and compressed along the closet rod 102. For example, the flexible material can allow for axial compression and extension of the main body 108 along the longitudinal axis 110, as shown in FIGS. 4-12. Non-limiting examples of flexible materials can include various types of plastics, rubber, etc. The main body 108 can also be provided in a variety of colors and patterns to be aesthetically pleasing for the user. Non-limiting examples of the colors can include chrome, black, white, brown, pink, etc. Non-limiting examples of patterns can include gloss and matte finishes. However, it should be appreciated that a skilled artisan can select different materials, colors, and patterns for the main body 108, within the scope of this disclosure.

With reference to FIGS. 1-12, the main body 108 can include a plurality of the ridges 114 and a plurality of grooves 116. Each of the ridges 114 can disposed on the main body 108. For example, each of the ridges 114 can be radially disposed on the main body 108 relative to the longitudinal axis 110. In certain examples, each of the ridges 114 can be disposed spaced apart from each other on the main body 108. In particular, each of the ridges 114 can be spaced apart from each other by a spacer width 118, as shown in FIG. 7. The spacer width 118 can be defined as a distance from a top 120 of one of the ridges 114 to the top 120 of an adjacent ridge 114. Desirably, the spacer width 118 can permit the hanger hooks 106 to be evenly spaced apart when disposed on the main body 108. Non-limiting examples of the spacer width 118 include distances of about 0.5 inches, 0.75 inches, 0.83 inches, 1.0 inch, and/or 2.0 inches. Although these example spacer width 118 dimensions are known to be useful, it should be appreciated that a person skilled in the art can select different dimensions for the spacer width 118, as desired.

In some instances, the top 120 of each of the ridges 114 can include a rounded top 122 (shown in FIGS. 1-3, 5, 7-8, and 12). Advantageously, the rounded top 122 can appear aesthetically pleasing to the user. In other instances, the top 120 can include a pointed top 124, as shown in FIGS. **6*a*-6*b*. The pointed top 124 can militate against the hanger hook 106 from accidentally moving out of one of the grooves 116 to another one of the grooves 116**.

Although the rounded top 122 and the pointed top 124 are described and shown as particular embodiments, for purposes of disclosing the invention, it should be appreciated that the main body 108 may be provided in one of a variety of shapes. Such shapes can include, as non-limiting examples, a round corrugated sleeve, an oval shaped sleeve, a square shaped sleeve, or even a rectangular shaped sleeve, all still with corrugations to separate hangers. Star-shaped, fluted-shape, and other suitable shapes or designs are also contemplated and considered to be within the scope of the present disclosure.

Now referring to FIGS. 1-2, 4, and 7-8, each of the grooves 116 can be disposed between two of the ridges 114. In addition, each of the grooves 116 can be configured to support the hanger hook 106, as shown in FIGS. 7-8. Advantageously, the grooves 116 in combination with the ridges 114 can allow for the hanger hooks 106 to be evenly spaced apart when each of the hanger hooks 106 is disposed in one of the grooves 116.

Although the grooves 116 are shown receiving each of the hanger hooks 106 in an approximately 90-degree angle of orientation relative to the longitudinal axis 110, it should be appreciated that the main body 108 can be designed to align hangers at other than a 90-degree angle to the longitudinal axis 110. As non-limiting examples, a 15-degree angle, a 30-degree angle, or a 45-degree angle could be used, such that hangers (with clothes) allow for improved display and are able to be better visualized within the closet. Other suitable angles can also be selected by the skilled artisan within the scope of the present disclosure.

With reference to FIG. **6*b*, each of the ridges 114 can have a first sloped side 126 and a second sloped side 128. Each of the grooves 116 can be disposed between the first sloped side 126 of one of the ridges 114 and the second sloped side 128 of another one of the ridges 114. When the hanger hook 106 is disposed in one the grooves 116, the first sloped side 126 of one of ridges 114 and the second sloped side 128 of another one of the ridges 114 can guide the hanger hook 106 to be centrally disposed in the one of the grooves 116. Desirably, this can be aesthetically pleasing to a user, and permit each of the hanger hooks 106 to be evenly spaced apart. Each of the grooves 116 can have a groove width 130. It should be appreciated that one skilled in the art can employ different slopes, contours, and methods to centrally dispose the hanger hook 106 in one of the grooves 116, within the scope of this disclosure. In certain examples, the groove width 130 can be about 0.825 inches. However, it should be appreciated that a person skilled in the art can select different dimensions for the groove width 130, as desired. Embodiments of the closet organizer 100, for example, can have groove widths 130 tailored to dimensions of selected sizes of hanger hooks 104 and hangers 104**.

As shown in FIGS. 1-2 and 4-8, one or more of the grooves 116 can be disposed orthogonal to the longitudinal axis 110. This can permit each of the hanger hooks 106 to be disposed orthogonal to the longitudinal axis 110, thereby aligning each garment orthogonal to the longitudinal axis 110. Advantageously, aligning each of the garments orthogonal to the longitudinal axis 110 can optimize the amount of space taken up by each garment on the main body 108. In certain examples, at least one of the grooves 116 may not be disposed orthogonal to the longitudinal axis 110 (not shown). Desirably, this can align the garment so a front of the garment can be viewable while being hung on the closet organizer 100. Non-limiting examples can include disposing one of the grooves 116 between forty to sixty degrees from the longitudinal axis 110. However, it should be appreciated that the groove can be disposed at different angles, as desired.

With reference to FIGS. 4-6*b*, 7-9, and 11-12, one or more of the ridges 114 can be configured to move between a compressed state 132 and an expanded state 134. For example, the ridge 114 can be moved to the expanded state 134 from the compressed state 132 with a sufficient pulling force by the user. In addition, the ridge 114 can be moved to the compressed state 132 from the expanded state 134 by a sufficient pushing force. The sufficient pulling force and/or the sufficient pushing force can be facilitated by having the material of the closet organizer 100 be bendable, stretchable, and/or foldable along transition lines, predetermined fold lines, creases, and/or hinges. However, it should be appreciated that other methods can be employed to facilitate moving the ridge 114 between the compressed state 132 and the expanded state 134.

In certain examples, in the compressed state 132, one of the ridges 114 can have a compressed ridge width 136, as shown in FIGS. 4 and 7. In the expanded state 134, one of the ridges 114 can have an expanded ridge width 138 (shown in FIGS. 4 and 7). The compressed ridge width 136 can be less than the expanded ridge width 138. This can directly influence the spacer width 118, e.g., when one of the ridges 114 moves to the compressed state 132, the adjacent spacer width 118 can decrease. When one of the ridges 114 moves to the expanded state 134, the adjacent spacer width 118 can increase. Advantageously, this can allow the user to compress and/or expand a predetermined number of the ridges 114 to customize the spacing between garments. For example, for thicker garments, such as coats, the user can move the predetermined number of ridges 114 to the expanded state 134, which can permit enough space for the thicker garments. For thinner garments, like t-shirts, the user can move the predetermined number of ridges 114 to the compressed state 132 to conserve space along the main body 108. It should be appreciated that a skilled artisan can select different configurations for the ridges 114, as desired.

Now referencing FIG. 6*b*, one or more ridges 114 can have a first angle 140 and a second angle 142. The first angle 140 can be relative to the longitudinal axis 110 and the first sloped side 126. The first angle 140 can change when the first sloped side 126 moves between the compressed state 132 and the expanded state 134. The second angle 142 can be relative to the longitudinal axis 110 and the second sloped side 128. The second angle 142 can change when the second sloped side 128 moves between the compressed state 132 and the expanded state 134. It should be appreciated that moving one of the ridges 114 between the compressed state 132 and the expanded state can include compressing or expanding the first sloped side 126 and/or the second sloped side 128. For example, when the first sloped side 126 of one of the ridges 114 is moved to the compressed state 132 from the expanded state 134, the first angle 140 can increase as the first sloped side 126 moves towards being orthogonal to the longitudinal axis 110. In another example, when the first sloped side 126 of one of the ridges 114 is moved to the expanded state 134 from the compressed state 132, the first angle 140 can decrease as the first sloped side 126 moves towards being parallel to the longitudinal axis 110. These same examples can be applicable to the second angle 142 with respect to the second sloped side 128.

In certain examples, with reference to FIGS. 6*a* and 11, when moving to the expanded state 134 from the compressed state 132, the first sloped side 126 and the second sloped side 128 can move towards being parallel to the longitudinal axis 110. When moving to the compressed state 132 from the expanded state 134, the first sloped side 126 and the second sloped side 128 can move towards being orthogonal to the longitudinal axis 110. As shown in FIG. 11, in certain examples, each of the ridges 114 can have a first transition line T1, a second transition line T2, and a third transition line T3. The first transition line T1 can be disposed along a center of each of the ridges 114. The first transition line T1 can be configured to facilitate a folding, stretching, and/or bending of the first sloped side 126 and the second sloped side 128 along the first transition line T1. The second transition line T2 can be disposed adjacent to the first sloped side 126 and the groove 116 that is adjacent to the first sloped side 126. The second transition line T2 can be oriented parallel to the first transition line T1. The second transition line T2 can be configured to facilitate a folding, stretching, and/or bending of the first sloped side 126 along the second transition line T2. The third transition line T3 can be disposed adjacent to the second sloped side 128 and the groove 116 that is adjacent to the second sloped side 128. The third transition line T3 can be oriented parallel to the first transition line T1. The third transition line T3 can be configured to facilitate a folding, stretching, and/or bending of the second sloped side 128 along the third transition line T3. However, it should be appreciated that other configurations for the transition lines can be contemplated, within the scope of this disclosure.

As shown in FIG. 12, in certain examples, when moving to the compressed state 132 from the expanded state 134, the second sloped side 128 can inverted into the first sloped side 126 and oriented substantially parallel to the first sloped side 126, while the first sloped side 126 remains in the expanded state 134. Desirably, this can reduce the spacer width 118 adjacent to the second sloped side 128, while keeping the spacer width 118 adjacent to the first sloped side 126 longer. The second sloped side 128 can then be moved to the expanded state 134 by pulled with a sufficient force to un-invert the second sloped side 128 to be a mirror image of the first sloped side 126. It should be appreciated that these same concepts can be applied to the first sloped side 126 (e.g., the first sloped side 126 can be inverted into the second sloped side 128 and oriented substantially parallel to the first sloped side 126 when being moved into the compressed state 132.

While still referring to FIG. 12, in certain examples, when each of the ridges 114 includes the rounded top 122, each of the ridges 114 can have a fourth transition line T4, a fifth transition line T5, and a sixth transition line T6, and a seventh transition line T7. The fourth transition line T4 can be disposed adjacent to the center of the ridge 114 and the first sloped side 126. The fourth transition line T4 can be configured to permit the first sloped side 126 to fold, stretch, and/or bend along the fourth transition line T4. The fifth transition line T5 can be disposed adjacent to the center of the ridge 114 and the second sloped side 128. The fifth transition line T5 can be oriented parallel to the fourth transition line T4. The fifth transition line T5 can be configured to permit the second sloped side 128 to fold, stretch, and/or bend along the fifth transition line T5. The sixth transition line T6 can be disposed adjacent to the first sloped side 126 and the groove 116 that is adjacent to the first sloped side 126. The sixth transition line T6 can be oriented parallel with the fourth transition line T4. The sixth transition line T6 can be configured to permit the first sloped side 126 to fold, stretch, and/or bend along the sixth transition line T6. The seventh transition line T7 can be disposed adjacent to the second sloped side 128 and the groove 116 that is adjacent to the second sloped side 128. The seventh transition line T7 can be oriented parallel with the fifth transition line T5. The seventh transition T7 can be configured to permit the second sloped side 128 to fold, stretch, and/or bend along the seventh transition line T7. However, it should be appreciated that other configurations for the transition lines can be contemplated, within the scope of this disclosure.

With reference to FIG. 6*a*, one or more ridges 114 can have a compressed ridge diameter 144 and an expanded ridge diameter 146. In certain examples, the compressed ridge diameter 144 can be not equal to the expanded ridge diameter 146. For example, the compressed ridge diameter 144 can be greater than the expanded ridge diameter 146, when both the first angle 140 and the second angle 142 move to the compressed state 132. In some instances, the compressed ridge diameter 144 and the expanded ridge diameter 146 can be substantially equal when only one of the first angle 140 and the second angle 142 moves to the compressed state 132. It should be appreciated that a skilled artisan can scale the compressed ridge diameter 144 and the expanded ridge diameter 146, within the scope of this disclosure.

Now referring to FIGS. 4 and 9, one or more ridges 114 can a first ridge peak 148 and a second ridge peak 150. As shown in FIG. 9, the first ridge peak 148 can include a first ridge peak outer side 152 and a first ridge peak inner side 154. The second ridge peak 150 can include a second ridge peak outer side 156 and a second ridge peak inner side 158. The first ridge peak inner side 154 can be disposed adjacent to the second ridge peak inner side 158. The first ridge peak outer side 152 can be disposed adjacent to the first ridge peak inner side 154 and not adjacent to the second ridge peak outer side 156 and the second peak inner side. The second ridge peak outer side 156 can be disposed adjacent to the second ridge peak inner side 158 and not adjacent to the first ridge peak inner side 154 and the first ridge peak outer side 152. The first ridge peak inner side 154 and/or the second ridge peak inner side 158 can be configured to be moved between the compressed state 132 and the expanded state 134. When moving from the expanded state 134 to the compressed state 132, the first ridge peak inner side 154 and/or the second ridge peak inner side 158 can move towards being orthogonal to the longitudinal axis 110. When moving to the expanded state 134, the first ridge peak inner side 154 and/or the second ridge peak inner side 158 can move towards being coplanar with each other and oriented substantially parallel to the longitudinal axis 110; e.g., "substantially flattened". Desirably, this can increase the expanded ridge width 138 to increase the spacing between garments. The first ridge peak inner side 154 and/or the second ridge peak inner side 158 can be moved between the compressed state 132 and the expanded state 134 with a sufficient pulling force by the user where the material of the closet organizer 100 can bendable, stretchable, and/or foldable along predetermined fold lines, creases and/or hinges.

With reference to FIG. 9, in certain examples, one or more of the ridges 114 can include an eighth transition line T8, a ninth transition line T9, and a tenth transition line T10. The eighth transition line T8 can be disposed between the first ridge peak inner side 154 and the second ridge peak inner side 158. The eighth transition line T8 can be configured to permit the first ridge peak inner side 154 and the second ridge peak inner side 158 to fold, stretch, and/or bend along the eighth transition line T8. The ninth transition line T9 can be disposed between the first ridge peak inner side 154 and first ridge peak outer side 152. The ninth transition line can be oriented parallel to the eighth transition line T8. The ninth transition T9 can be configured to allow the first ridge peak inner side 154 and the first ridge peak outer side 152 to fold, stretch, and/or bend along the ninth transition line T8. The tenth transition line T10 can be disposed between the second ridge peak inner side 158 and second ridge peak outer side. The tenth transition line T10 can be oriented parallel to the eighth transition line T8. The tenth transition line T10 can be configured to allow the second ridge peak inner side 158 and the second ridge peak outer side 156 to fold, stretch, and/or bend along the tenth transition line T10. However, it should be appreciated that other configurations for the transition lines can be contemplated, within the scope of this disclosure.

With reference to FIGS. 5 and 10, one or more grooves 116 can a first groove peak 160 and a second groove peak 162. As shown in FIG. 10, the first groove peak 160 can have a first groove peak inner side 164 and a first groove peak outer side 166. The second groove peak 162 can include a second groove peak inner side 168 and a second groove peak outer side 170. The first groove peak inner side 164 can be disposed adjacent to the second groove peak inner side 168. The first groove peak outer side 166 can be disposed adjacent to the first groove peak inner side 164 and not adjacent to the second groove peak inner side 168. The second groove peak outer side 170 can be disposed adjacent to the second groove peak inner side 168 and not adjacent to the first groove peak inner side 164. The first groove peak 160 and the second groove peak 162 can be configured to be moved between a groove compressed state 172 and a groove expanded state 174. When moving to the groove compressed state 172, each of the first groove peak inner side 164, the first groove peak outer side 166, the second groove peak inner side 168, and/or the second groove peak outer side 170 can move towards being orthogonal with the longitudinal axis 110. When moving to the grove expanded state 174, each of the first groove peak inner side 164, the first groove peak outer side 166, the second groove peak inner side 168, and/or the second groove peak outer side 170 can move towards being coplanar with each other and be oriented substantially parallel with the longitudinal axis (or in other words "flattened"). Desirably, this can increase the groove width 130 to increase the spacing between garments. The first groove peak 160 and the second groove peak 162 can be moved between the groove compressed state 172 and the groove expanded state 174 with a sufficient pulling force by the user where the material of the closet organizer 100 can bendable, stretchable, and/or foldable along predetermined fold lines, creases and/or hinges.

In certain examples, one or more grooves 116 can include an eleventh transition line T11, a twelfth transition line T12, a thirteenth transition line T13, a fourteenth transition line T14, and a fifteenth transition line T15. The eleventh transition line T11 can be disposed between the first groove peak inner side 164 and the second groove peak inner side 168. The eleventh transition line T11 can be configured to allow the first groove peak inner side 164 and the second groove peak inner side 168 to fold, stretch, and/or bend along the eleventh transition line T11. The twelfth transition line T12 can be disposed between the first groove peak inner side 164 and the first groove peak outer side 166. The twelfth transition line T12 can be parallel with the eleventh transition line T11. The twelfth transition line T12 can be configured to permit the first groove inner side and the first groove peak outer side 166 to fold, stretch, and/or bend along the twelfth transition line T12. The thirteenth transition line T13 can be disposed between the second groove peak inner side 168 and the second groove peak outer side 170. The thirteenth transition line T13 can be parallel with the twelfth transition line T12. The thirteenth transition line T13 can be configured to allow the second groove peak inner side 168 and the second groove peak outer side 170 to fold, stretch, and/or bend along the thirteenth transition line T13. The fourteenth transition line T14 can be disposed between the first groove peak outer side 166 and the ridge 114 that is adjacent to the first groove peak outer side 166. The fourteenth transition line T14 can be parallel with the thirteenth transition line T13. The fourteenth transition line T14 can be configured to permit the first groove peak outer side 166 to fold, stretch, and/or bend along the fourteenth transition line T14. The fifteenth transition line T15 can be disposed between the second groove peak outer side 170 and the ridge 114 that is adjacent to the second groove peak outer side 170. The fifteenth transition line T15 can be parallel with the fourteenth transition line T14. The fifteenth transition line T15 can be configured to permit the second groove peak outer side 170 to fold, stretch, and/or bend along the fifteenth transition line T15. However, it should be appreciated that other configurations for the transition lines can be contemplated, within the scope of this disclosure.

As shown in FIG. 2, the main body 108 can have a slit 176. The slit 176 can be formed along the main body 108 on the longitudinal axis 110. The slit 176 can be configured to receive the closet rod 102. Desirably, this can allow the main body 108 to be disposed on the closet rod 102. In addition, the flexible material can permit the slit 176 to conform over a closet rod 102 that is square or where a diameter of the closet rod 102 is larger than a width of the slit 176. It should also be appreciated that the slit 176 can be formed as a substantially closed cut along the length of the main body 108, for example, as shown in FIGS. 13 and 14, and that this slit 176 may be opened in operation when the main body 108 is resting on a closet rod, for example, as shown in FIGS. 2 and 3. The opening of the slit 176 may vary depending on the diameter of the close rod such as 1-⅜" or 1-⅝" closet rods, as non-limiting examples. However, it should be appreciated that a skilled artisan can employ other technologies and methods to put the main body 108 in cooperation with the closet rod 102.

Figure 1:
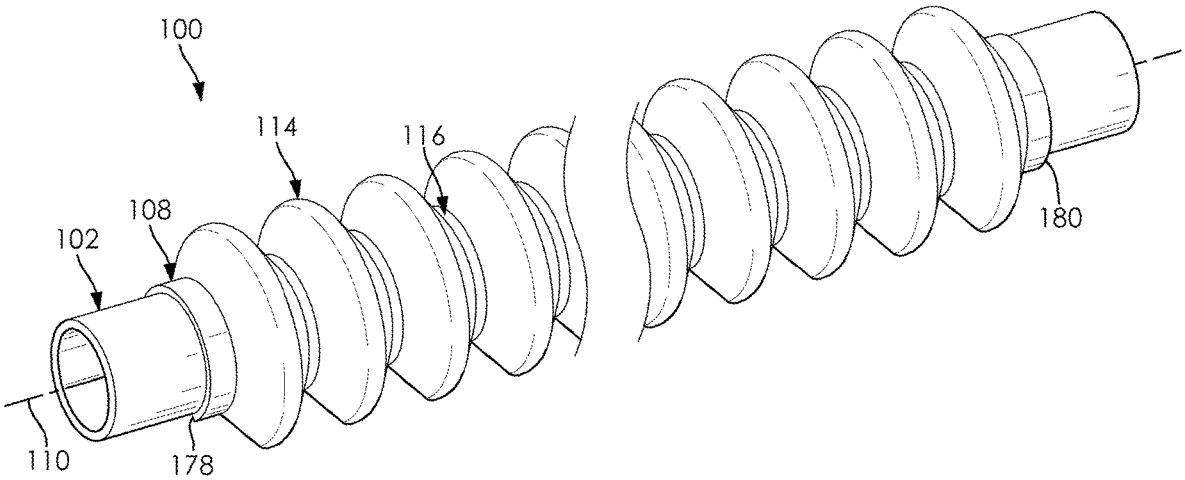
FIG. 1 is a top perspective view of a closet organizer disposed on a closet rod, according to certain embodiments, including a plurality of ridges and a plurality of grooves.
Figure 2:
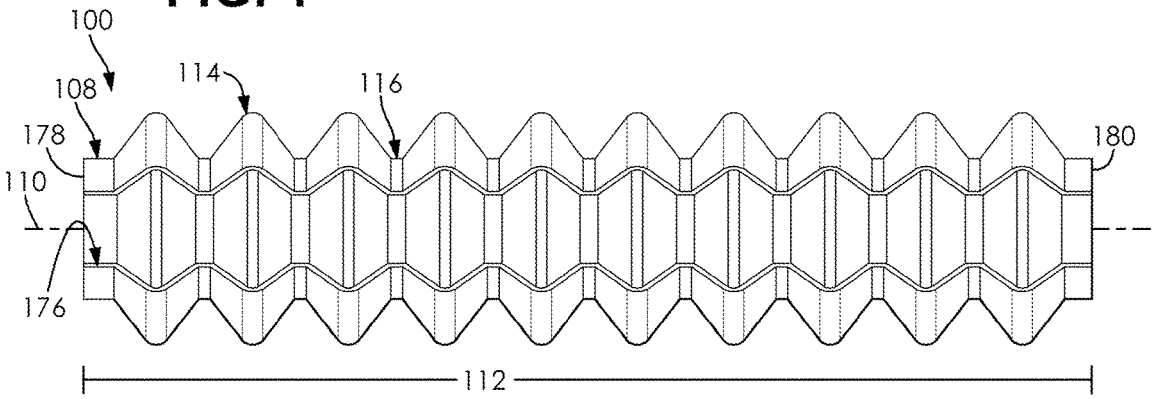
FIG. 2 is a bottom plan view of the closet organizer, according to certain embodiments, including a slit formed on a main body of the closet organizer, and the slit shown opened due to the placement of the closet organizer over a closet rod.
Figure 3:
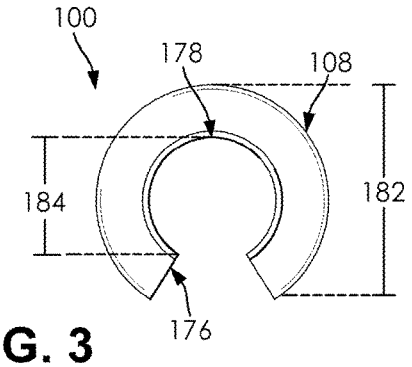
FIG. 3 is a left side elevational view of the closet organizer shown in FIG. 2, including a first end aperture.

In certain examples, the main body 108 can be hollow with a first end aperture 178 and a second end aperture 180, as shown in FIGS. 1-2 and 8. The first end aperture 178 and/or the second end aperture 180 can be configured to receive the closet rod 102. Desirably, this can allow the closet organizer 100 to act as a sleeve for the closet rod 102. The main body 108 can have an inner diameter 184 and an outer diameter 182, as shown in FIG. 3. The inner diameter 184 can be substantially the same or slightly greater than a diameter of the closet rod 102, which can allow the main body 108 to act as a sleeve for the closet rod 102. Embodiments also include where the inner diameter 184 is slightly smaller than the diameter of the closet rod (e.g., <5% smaller) so that the closet organizer 100 fits snuggly on the closet rod 102 to minimize any movement or rotation relative thereto. In certain examples, the inner diameter 184 can be between about 1.0 inches to about 1.325 inches and the outer diameter 182 can be about 2.19 inches. However, it should be appreciated that a skilled artisan can select different dimensions for the inner diameter 184 and the outer diameter 182, as desired.

As shown in FIG. 15, a method 200 for using the closet organizer 100 configured to cooperate with the closet rod 102 and support the hanger hook 106 is shown. The method 200 can include a step 202 of providing the closet organizer 100. In a step 204, the closet organizer 100 can be coupled with the closet rod 102. In certain examples, this can include receiving the closet rod 102 via the slit 176. In other examples, this can include positioning the closet rod 102 inside the main body 108 via the first end aperture 178 and/or the second end aperture 180. One of the ridges 114 can be selectively positioned to the compressed state 132 and/or the expanded state 134, in a step 206. Desirably, this can allow the user to customize the closet organizer 100 to accommodate thinner and/or larger garments.

With reference to FIG. 16, another embodiment of the method 200' can include a step 208 of cutting the main body 108 so that the max length 112 of the main body 108 is substantially equal to a rod length of the closet rod 102. Advantageously, this can permit the main body 108 to cover an entirety of the rod length of the closet rod 102.

Advantageously, the closet organizer 100 and the method 200 provided by the present technology can facilitate spacing the hanger hooks 106 evenly apart along the closet rod 102 via the ridges 114 and the grooves 116. In addition, the closet organizer 100 can be cut to substantially match the max length 112 of the main body 108 with the rod length of the closet rod 102, which can accommodate closet rods of varying lengths.

In yet another embodiment, it should be appreciated that the closet organizer 100 may be provided as a solid (or rigid) tube or rod that would function in place of the existing closet rod. In this case, there would be no sleeve-type device to fit over an existing rod, as the closet organizer 100 itself would take the place of the clothes rod.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments can be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. A closet organizer configured to cooperate with a closet rod and to support a hanger hook, comprising:

a main body with a longitudinal axis, the main body including:

a plurality of ridges, each of the ridges radially disposed on the main body relative to the longitudinal axis and having a first sloped side and a second sloped side;

a plurality of grooves, each of the grooves disposed between the first sloped side of one ridge and the second sloped side of another ridge, each of the grooves configured to receive the hanger hook; and a slit formed along the main body on the longitudinal axis and configured to receive the closet rod, thereby allowing the main body to be disposed about the closet rod.

2. The closet organizer of claim 1, wherein one of the ridges is configured to move between a compressed state and an expanded state.

3. The closet organizer of claim 2, wherein the one of the ridges in the compressed state has a compressed ridge width and the one of the ridges in the expanded state has an expanded ridge width, and the compressed ridge width is smaller than the expanded ridge width.

4. The closet organizer of claim 1, wherein each of the ridges includes a rounded top.

5. The closet organizer of claim 1, wherein each of the ridges includes a pointed top.

6. The closet organizer of claim 1, wherein one of the grooves is disposed orthogonal to the longitudinal axis.

7. The closet organizer of claim 1, wherein one of the grooves is disposed not orthogonal to the longitudinal axis.

8. The closet organizer of claim 7, wherein the one of the grooves is disposed about forty to about sixty degrees from the longitudinal axis.

* * * * *